US006668413B2

(12) United States Patent
Fortier

(10) Patent No.: US 6,668,413 B2
(45) Date of Patent: Dec. 30, 2003

(54) POOL BRUSH WITH DUAL-POSITION HYDROFOIL

(75) Inventor: Rejean Fortier, Hollywood, FL (US)

(73) Assignee: Scanner G. Contractor, Inc., Davie, FL (US)

( * ) Notice: Subject to any disclaimer, the term of this patent is extended or adjusted under 35 U.S.C. 154(b) by 22 days.

(21) Appl. No.: 09/998,722

(22) Filed: Nov. 30, 2001

(65) Prior Publication Data

US 2003/0102009 A1 Jun. 5, 2003

(51) Int. Cl.[7] ..... E04H 4/16; B63B 59/08
(52) U.S. Cl. ..... 15/1.7; 15/246; 114/222
(58) Field of Search ..... 15/1.7, 160, 246, 15/257.01; 134/6; 114/222; D32/50, 51

(56) References Cited

U.S. PATENT DOCUMENTS

| | | | | | |
|---|---|---|---|---|---|
| 238,624 | A | * | 3/1881 | Westberg | 114/222 |
| 2,243,576 | A | * | 5/1941 | Otto | 15/160 |
| 3,003,168 | A | * | 10/1961 | Shouldice | 15/1.7 |
| 3,008,160 | A | * | 11/1961 | West | 15/1.7 |
| 3,402,413 | A | * | 9/1968 | Gibellina | 15/1.7 |
| 4,637,087 | A | | 1/1987 | Feinberg | 15/1.7 |
| 4,733,427 | A | | 3/1988 | Conrad | 15/1.7 |
| 4,742,592 | A | | 5/1988 | Addona, Sr. | 15/1.7 |
| 4,749,478 | A | | 6/1988 | Brooks | 15/1.7 |
| 4,783,868 | A | | 11/1988 | O'Callaghan | 15/1.7 |
| 4,909,173 | A | * | 3/1990 | Strong | 114/222 |
| 4,962,558 | A | * | 10/1990 | Harrell, Jr. | 15/1.7 |
| 5,487,397 | A | | 1/1996 | Bean | 15/1.7 |
| 5,539,947 | A | * | 7/1996 | Kiraly | 15/1.7 |
| 5,864,917 | A | * | 2/1999 | Landsman | 15/246 |
| 5,983,431 | A | | 11/1999 | Meshulam | 15/1.7 |
| 6,148,466 | A | * | 11/2000 | Smitelli et al. | 15/160 |
| 6,301,737 | B1 | * | 10/2001 | Morse | 15/1.7 |

* cited by examiner

*Primary Examiner*—Gary K. Graham
(74) *Attorney, Agent, or Firm*—Laurence A. Greenberg; Werner H. Stemer; Loren D. Pearson

(57) ABSTRACT

A pool brush includes a hydrofoil moving on a hinge. The hydrofoil provides downforce on the surface being brushed regardless of the direction of the pool brush (pulled or pushed). Adjustable front and rear stops allow the amount of downforce to be adjusted and to compensate for larger and deeper pools. The hydrofoil also creates a method for laterally steering the pool brush by twisting the handle.

8 Claims, 3 Drawing Sheets

POOL BRUSH WITH DUAL-POSITION HYDROFOIL

BACKGROUND OF THE INVENTION

1. Field of the Invention

The invention relates to pool brushes and, in particular, to hydrofoils for increasing the downforce on the surface being cleaned while sweeping in both directions. The invention also relates to a method for steering a pool brush.

2. Description of the Related Art

Part of the regular maintenance of swimming pools involves brushing the walls and bottom of the pool with a brush. To remove dirt and algae, the wall or bottom must be brushed with sufficient force. A long handle is connected to the brush to allow the brush to reach the bottom and the middle of the pool.

For larger pools, longer handles must be used to reach the center of the pool bottom. With longer handles, the amount of leverage required on the handle to create a sufficient force of the brush on the surface also increases. Likewise, the amount of force on the handle to steer the brush right and left also increases.

To increase downforce on the surface, hydrofoils have been added to brushes. The angle of the hydrofoils causes a downforce on the surface being cleaned as the brush and hydrofoil are moved through the water.

Hydrofoils that are fixed provide downforce when the brush is moved in one direction. Usually, the hydrofoil has been angled to provide downforce when the brush is pushed away from the person operating the pool brush: i.e., the cleaner. Fixed hydrofoils however provide lift, not downforce, when reciprocated and pulled toward the cleaner.

In the prior art, to reduce drag and lift, hinges have been added allowing the hydrofoil to swing freely into a position of no resistance. However, in this position, the brush can be pulled back without resistance but the hydrofoil does not provide any downforce.

O'Callaghan (U.S. Pat. No. 4,783,868) discloses a free-rotating vane for an underliquid cleaning device. The vane pivots back and forth depending on the direction that the brush is pushed. Stops limit the angle that the plate can be positioned. In O'Callaghan, the stops are not adjustable. In addition, the vane contains holes merely made during the construction of the hinge. O'Callahan's holes are not constructed (i.e., sized, located, angled) for steering.

Feiberg (U.S. Pat. No. 4,637,087) discloses a fixed water foil that has a rubber surface acting like a check valve. The water foil angle cannot be adjusted. The water foil only provides force when pushed, but not when pulled.

Conrad (U.S. Pat. No. 4,733,427) discloses a hinged wing attached to a brush. The wing provides a downforce when the brush is pushed and pivots in line with the pole when pulled. The angle of the wing is not adjustable. The wing is designed not to contact the surface when pulled.

Meschulam (U.S. Pat. No. 5,983,431) discloses a fixed attachment that attaches to a brush. The attachment includes flow apertures.

SUMMARY OF THE INVENTION

It is accordingly an object of the invention to provide pool brush with dual-position hydrofoil that overcomes the above-mentioned disadvantages of the heretofore-known devices and methods of this general type.

With the foregoing and other objects in view there is provided, in accordance with the invention, a pool brush for moving through a fluid in forward and reverse directions along a surface: i.e., the pool bottom or pool wall. The pool brush includes a brush, a hydrofoil, and a hinge connecting the brush and the hydrofoil. For reasons discussed below, the brush is preferably round. The hydrofoil rotatably connects to the brush and forms an obtuse angle to the direction in which the brush is being pushed. The hinge allows the hydrofoil to rotate so that the obtuse angle can be maintained.

In accordance with a further object of the invention, the pool brush includes a front stop. The front stop limits the angle when the brush is moved in the reverse direction, i.e., when the brush is being pulled toward the cleaner. The front stop contacts the hydrofoil and limits the angle that the hydrofoil goes forward. The adjustable front stop therefore prevents the hydrofoil from falling to a position of no resistance.

In accordance with a further object of the invention, the front stop is adjustable. By being adjustable, the front stop can provide an optimum angle regardless of the length of the handle. In addition, an adjustable front stop lets the drag be decreased by increasing the obtuse angle.

In accordance with a further object of the invention, the pool brush includes a rear stop limiting the obtuse angle when the brush is moved in the forward direction: i.e., pushed away from the cleaner. The rear stop performs the same functions as the front stop when the brush is moved in the forward direction. The rear stop also can be adjustable in order to perform the same purposes as the adjustable front stop but when the brush is moved in the forward direction.

In accordance with a further object of the invention, the brush has at least a semicircular cross section. The round part of this semicircular cross section faces the surface to be cleaned. The brush can be more than a semicircular and even fully circular. By having a semicircular cross section, the surface being cleaned will always be tangential to some part of the semicircular brush regardless of the angle of the handle/brush, which may change depending on the depth of the pool and the length of the handle being used.

In accordance with a further object of the invention, the pool brush includes a connector. The connector connects to the brush. Handles of various lengths can be attached to the connector unusually by spring-loaded prongs or screws. The length of the handle also can be adjustable by telescoping. By being able to connect to different length handles, the length required to reach the center of the pool can be added or extended. The connector preferably forms an acute angle from the surface being cleaned toward the cleaner.

In accordance with a further object of the invention, the hydrofoil can have a slot formed therein. The slot allows water to stream through. As the water streams through the slot, the pool brush is kept straight by the momentum of the flow.

In accordance with a further object of the invention, the brush has a rubber base and bristles protrude from the rubber base. The hinge can have an iron hanger around which the rubber base can be formed.

In accordance with a further object of the invention, the pool brush can include a handle connected to the brush. As stated, the handle preferably connects to the brush via the connector. The handle should have a length long enough to reach at least the center of the pool.

With the objects of the invention in view, there is also provided a method for cleaning an underwater surface. The first step of the method is providing a pool brush as described above. The pool brush includes a brush, a hydrofoil rotatably connected to the brush that forms an obtuse angle to the direction of brushing (i.e. pushing or pulling), a hinge connecting the brush and the hydrofoil, the hinge rotating the hydrofoil and maintaining the obtuse angle, and a handle connected to the brush. The next step is moving the brush along the surface in a forward direction while allowing the hydrofoil to pivot to an obtuse angle to the forward direction. The next step is moving the brush along the surface (i.e. the wall or bottom) in a reverse direction while allowing the hydrofoil to pivot to an obtuse angle to the reverse direction.

In accordance with a further mode of the invention, the method includes steering the brush left by rotating the handle clockwise while moving the brush in either the forward or reverse direction.

In accordance with a further object of the invention, the method includes steering the brush right by rotating the handle counterclockwise while moving the brush in either the forward or the reverse direction.

Other features which are considered as characteristic for the invention are set forth in the appended claims.

Although the invention is illustrated and described herein as embodied in pool brush with dual-position hydrofoil and method for steering, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
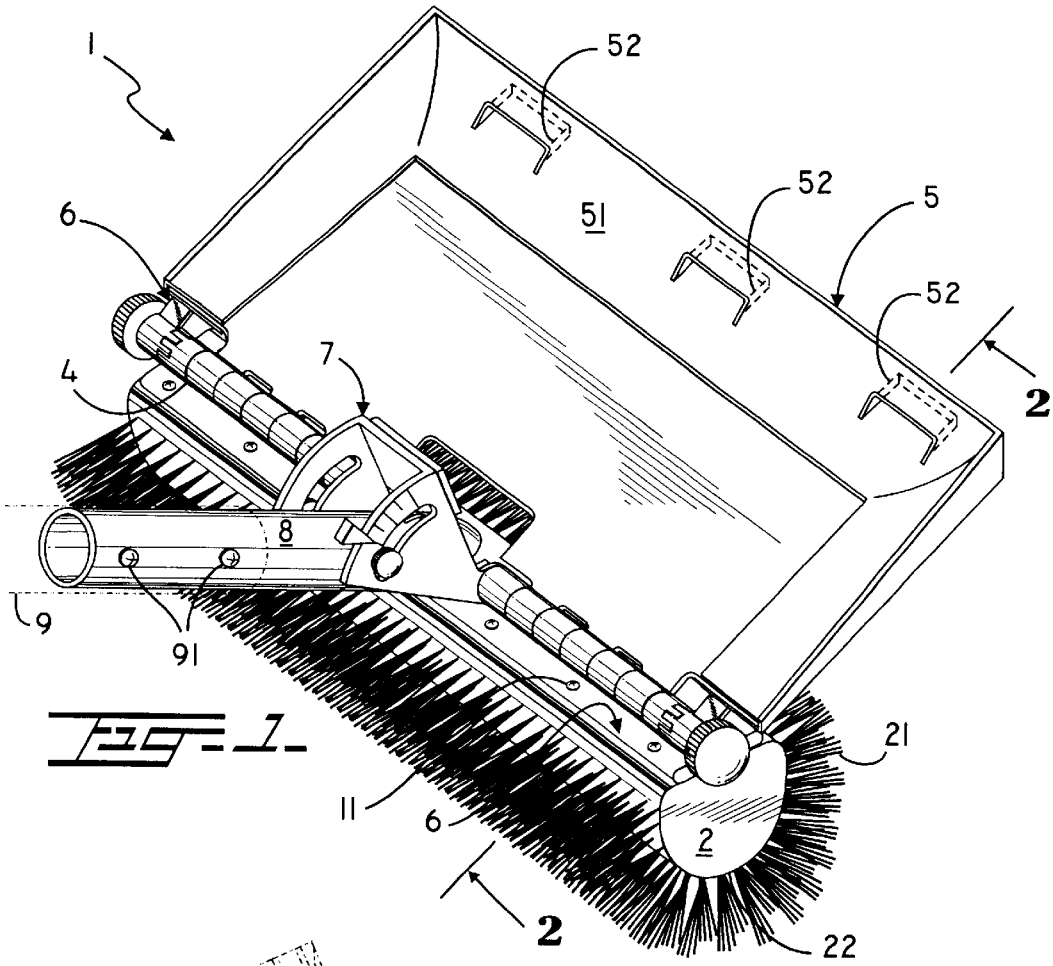
FIG. 1 is a perspective view of a pool brush.

Referring now to the figures of the drawing in detail and first, particularly, to FIG. 1 thereof, there is seen a pool brush generally marked with reference numeral 1.

Figure 2:
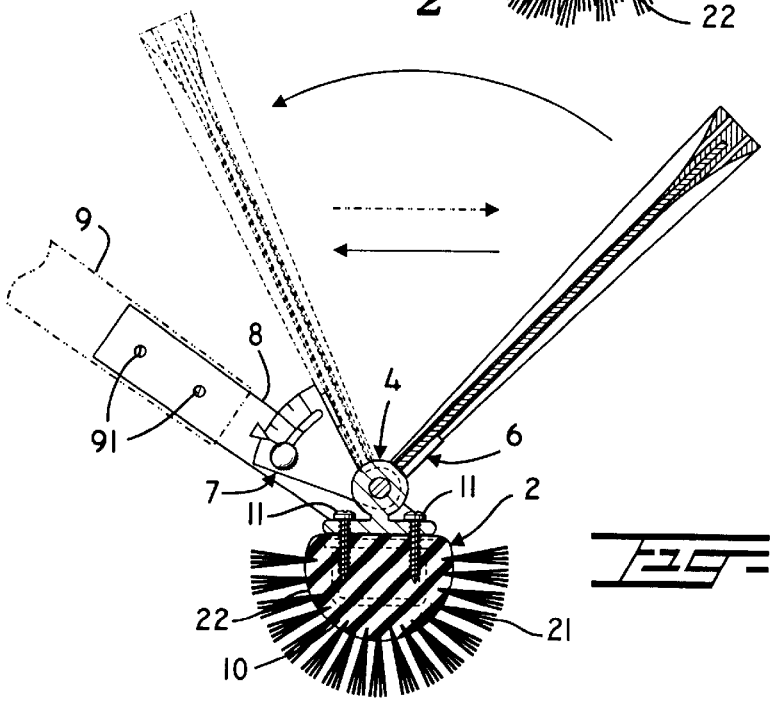
FIG. 2 is a cross-sectional view of the pool brush taken along the line 2—2 shown in FIG. 1.
Figure 4:
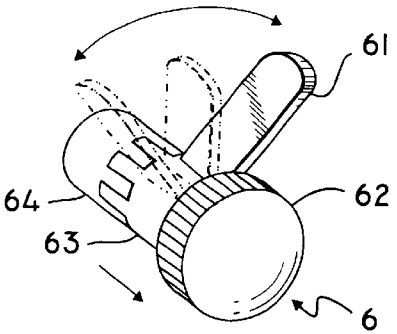
FIGS. 4 and 5 show an adjustable stop.
Figure 5:
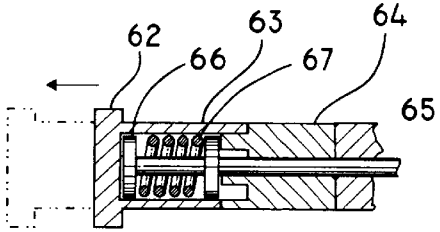
Figure 3:
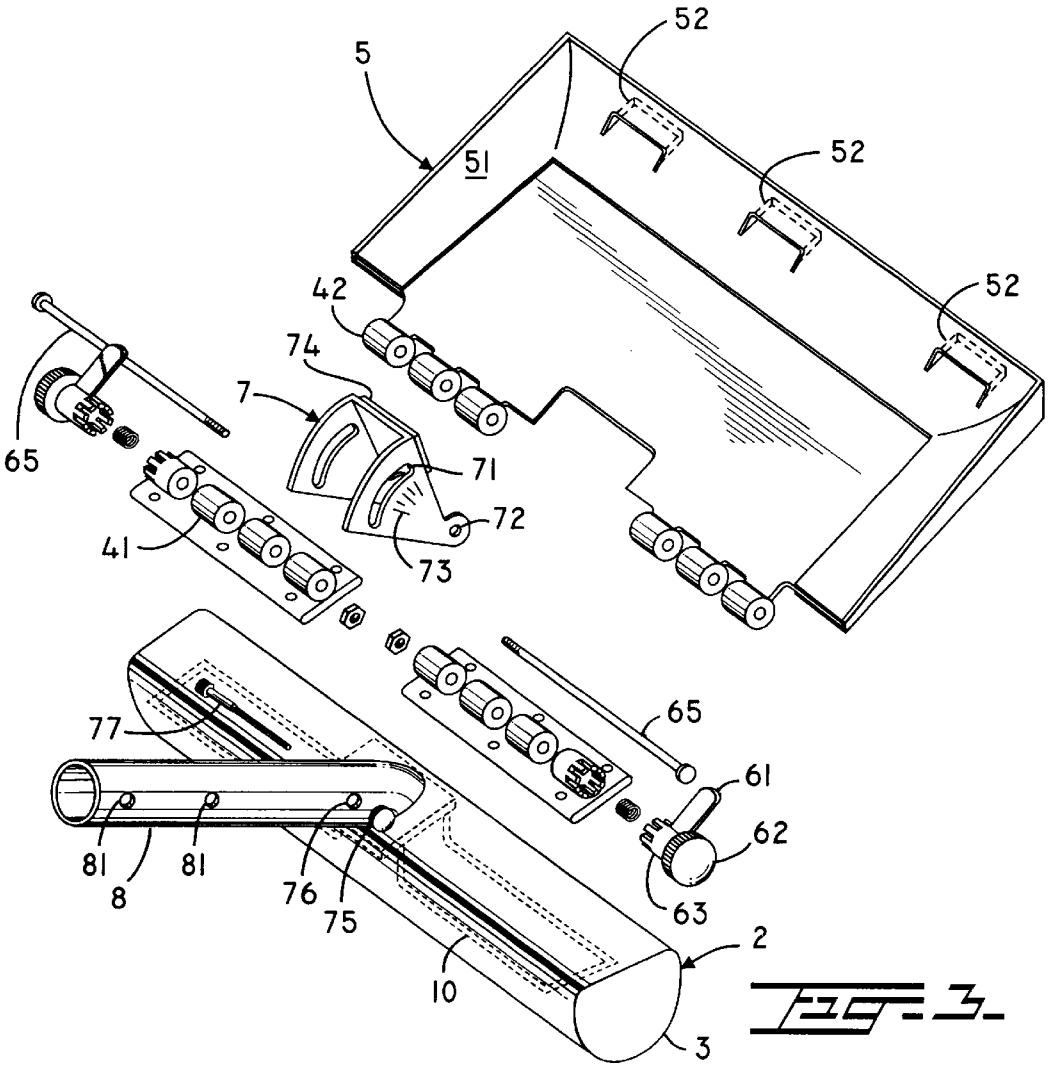
FIG. 3 is an exploded view of the pool brush.

The pool brush 1 includes a brush 2. The brush 2 is made of rubber. Preferably, the brush 2 has a semicircular cross-section 22; see FIG. 2. Bristles 21 extend from the brush 2. The semicircular cross-section 22 allows the brush 2 to be perpendicular to the surface regardless of the angle at which the handle 9 is held to the surface being cleaned.

A hinge 4 connects to the brush 2. Preferably, the hinge 4 is a piano hinge. The hinge 4 includes a first set of eyes 41 on the brush intermeshing with a second set of eyes 42. A pin 65 is threaded through the first set of eyes 41 and the second set of eyes 42 and connects them. Screws 11 fasten the hinge 4 to the brush 2. The screws 11 penetrate the brush 2.

A hydrofoil 5 rotatably connects to the hinge 4. The hydrofoil 5 rotates on the hinge 4 relative to the brush 2. The hydrofoil 5 maintains an obtuse angle with the direction in which the pool brush 1 is moved. Regardless of the direction of the brushing (forward or backward), the hydrofoil 5 rotates on the hinge 4 to maintain the obtuse angle. The obtuse angle moving through the water creates a downforce on the brush 2. The downforce from the hydrofoil 5 allows a brusher to press the brush down with less force. In addition, because the pool brush 1 provides downforce whether is pushed or pulled, the pool brush 1 is twice as efficient as brushes that only provide downforce when moved in one direction. The hydrofoil can be made from a light strong material such as aluminum, resin, stainless steel, etc.

Slots 52 are formed in the hydrofoil 5. When water flows through the slots 52 as the pool brush 1 is being moved, the flow causes the pool brush 1 to continue moving straight.

A rim 51 is added around the periphery of the hydrofoil 5. The rim 51 deflects water flowing by the hydrofoil 5 and provides additional downforce.

A front stop 6 limits the angle formed by the hydrofoil 5 when the pool brush 1 is moved in the reverse direction (toward the brusher). The front stop 6 abuts the hydrofoil 5 to prevent it from rotating further on the hinge 4. The front stop 6 is adjustable. By adjusting the front stop 6, the angle can be controlled. Typically, the front stop 6 will be adjusted to provide sufficient downforce while minimizing drag. The adjustment is also necessary because the optimal angle may change depending on the depth of the pool and the distance from the brusher. The front stop 6 includes a stationary gear 64 that releasably engages a clutch gear 63 that includes a knob 62. The stationary gear 64 has a plurality of crenels and merlons that intermesh with a complementary series of crenels and merlons on the clutch gear 63. A spring 67 holds the clutch gear 63 in an engaged position. By pulling on the knob 62 and compressing the spring 67, the clutch gear 63 can be released from and rotated relative to the stationary gear 64; this moves the tab 61 and adjusts the angle. Markings can be added to indicate the angle.

A connector 8 connects to the brush 2 and extends at an acute angle toward the brusher. A handle 9 connects to the connector 8. Screws 91 fasten the connector 8 to the handle 9. Different lengths of handles 9 can be attached to the connector depending on the size and depth of the pool. A reinforcement 10 extends laterally from the connector 8. The brush is then formed around the reinforcement 10.

A rear stop 7 limits the angle formed by the hydrofoil 5 when the pool brush 1 is moved in the forward direction (away from the brusher). The rear stop 7 abuts the hydrofoil 5 to prevent it from rotating further on the hinge 4. The rear stop 7 is adjustable. By adjusting the rear stop 7, the angle can be controlled. Typically, the rear stop 7 will be adjusted to provide sufficient downforce while minimizing drag. The adjustment is also necessary because the optimal angle may change depending on the depth of the pool and the distance from the brusher. The rear stop 7 includes a guide channel 71 and a pivot. The rear stop 7 rotates about the pivot 71. The pivot 72 is fixed to the connector 8. A bolt 77 extends through the hole 76 in the connector and through the guide channel 71. A nut 75 fastens the rear stop to the bolt 77. Markings 73 allow the rear stop to be precisely adjusted.

Figure 6:
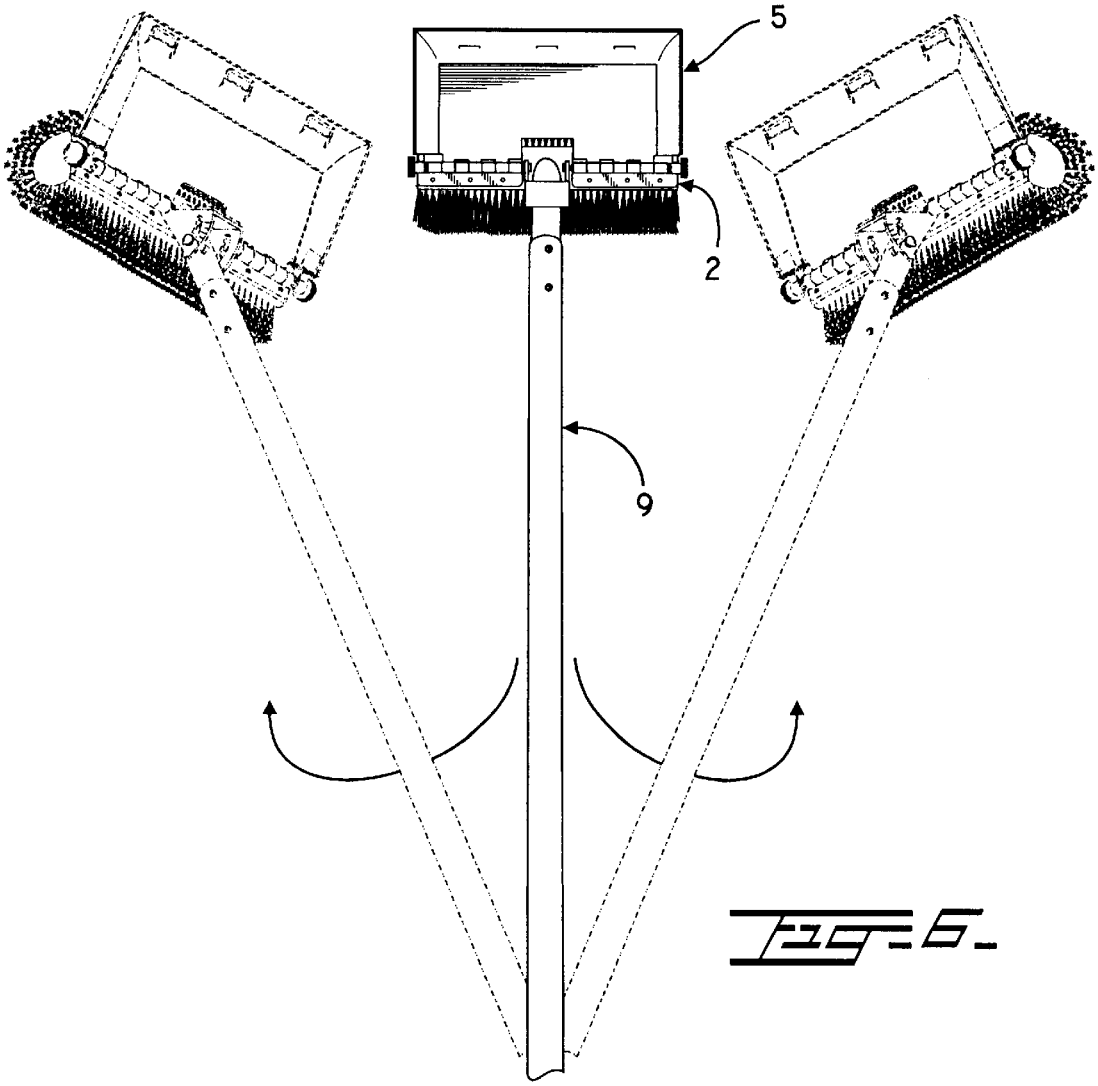
FIG. 6 is a top view of the pool brush and, in phantom, steering right and steering left.

FIG. 6 illustrates a method of steering the pool brush 1. By rotating the handle 10, the hydrofoil 5 becomes skewed relative to the surface being cleaned. As the pool brush 1 is moved the downforce created by the pool brush 1 then moves the pool brush 1 laterally. To steer the pool brush 1 right, the brusher would rotate the handle counterclockwise.

To steer the pool brush 1 left, the brusher would rotate the handle clockwise. Because the bottom and walls of the pool are usually brushed in rows, the ability to steer the pool brush 1 with a minimum effort makes moving the pool brush from row to row much easier.

I claim:

1. A pool brush for moving through a fluid in forward and reverse directions along a surface, comprising:

a brush;

a hydrofoil rotatably connected to said brush and forming an obtuse angle to the surface when moved in one of the directions;

a hinge between said brush and said hydrofoil, said hinge allowing said hydrofoil to rotate and maintain the obtuse angle; and an adjustable front stop limiting the angle when the brush is moved in the reverse direction.

2. The pool brush according to claim 1, including a rear stop limiting the obtuse angle when the brush is moved in the forward direction.

3. The pool brush according to claim 1, wherein said brush has at least a semicircular cross section.

4. The pool brush according to claim 1, including a connector for connecting said brush to a handle.

5. The pool brush according to claim 4, wherein said connector forms an acute angle with one of the directions.

6. The pool brush according to claim 1, wherein said hydrofoil has a slot formed therein.

7. The pool brush according to claim 1, wherein said brush has a rubber base and bristles protruding from said rubber base.

8. The pool brush according to claim 1, including a handle connected to said brush.

* * * * *